US005894299A

United States Patent [19]

Tsuchiya et al.

[11] Patent Number: 5,894,299

[45] Date of Patent: Apr. 13, 1999

[54] DRIVE SYSTEM FOR A FLAT TYPE DISPLAY DEVICE

[75] Inventors: Itaru Tsuchiya; Kenichi Hanada, both of Yamanashi-ken, Japan

[73] Assignees: Pioneer Electronic Corporation, Tokyo; Pioneer Video Corporation, Yamanashi-ken, both of Japan

[21] Appl. No.: 08/697,859

[22] Filed: Aug. 30, 1996

[30] Foreign Application Priority Data

Sep. 1, 1995 [JP] Japan ..... 7-225563

[51] Int. Cl.[6] ..... G09G 3/36

[52] U.S. Cl. ..... 345/100; 345/99

[58] Field of Search ..... 345/87, 103, 132, 345/100, 99

[56] References Cited

U.S. PATENT DOCUMENTS 5,448,260 9/1995 Zenda et al. ..... 345/132

5,742,272 4/1998 Kitamura et al. ..... 345/132

5,754,160 5/1998 Shimizu et al. ..... 345/132

*Primary Examiner*—Matthew Luu

*Attorney, Agent, or Firm*—Morgan, Lewis & Bockius LLP

[57] ABSTRACT

The number of vertical scanning in one field of a video signal is detected, and the number of scanning lines pulses at each row electrode of a liquid crystal display is determined in accordance with the difference between the determined number of vertical scanning lines number and the number of the row electrodes. The determined number of scanning pulses is stored in a retrace line interval. Scanning pulses are applied to the corresponding row electrode in a scanning interval. The number of row electrodes to which the scanning pulses are applied is the stored number of scanning pulses.

10 Claims, 7 Drawing Sheets

C

H

A
0
1
2
3
4
5

G

R

P

L

AA
0
1
2
3
4
5

B1

B2

B3

B4

B5

S1

S2

S3

S4

S5

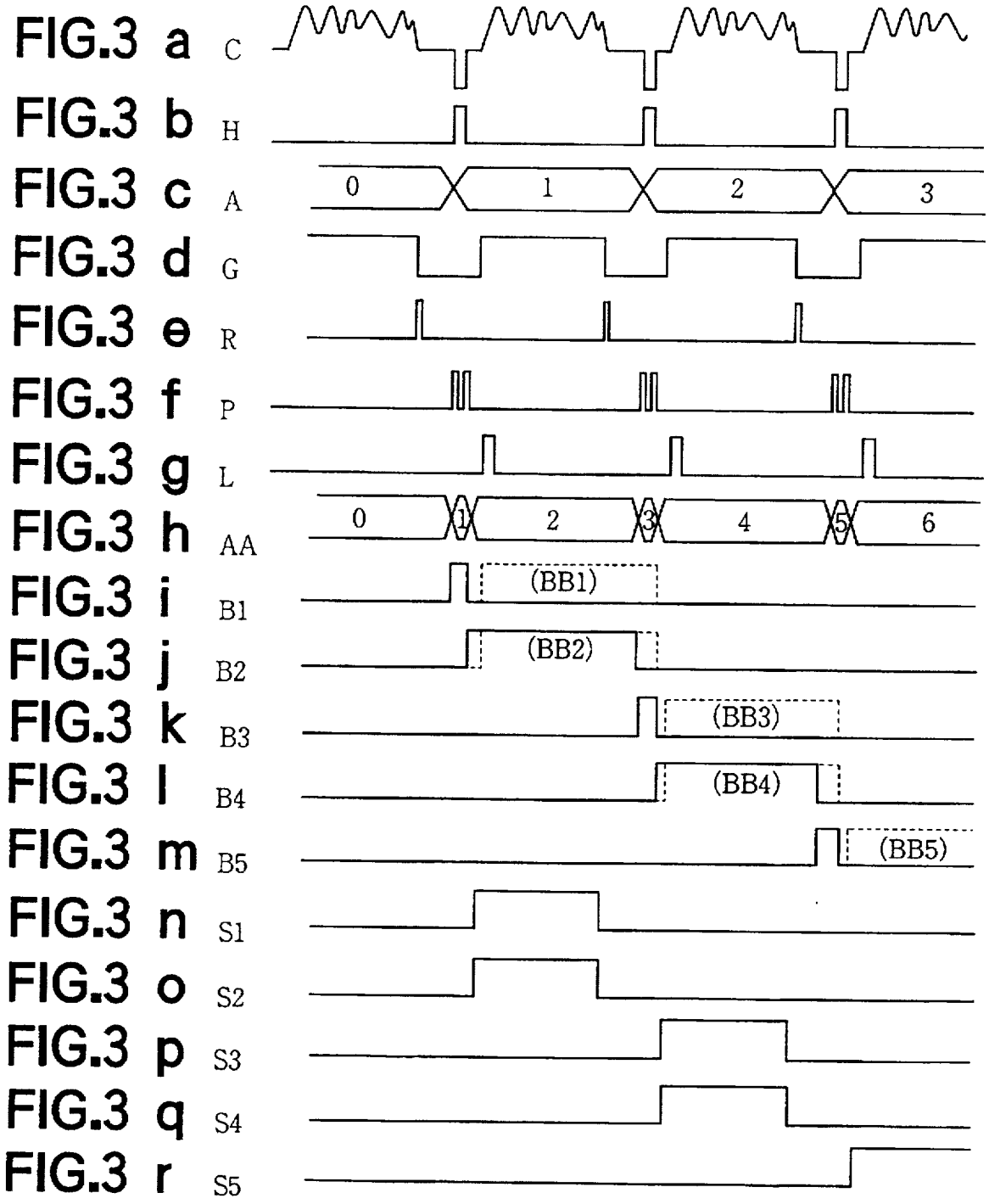
FIG.3 a C
FIG.3 b H
FIG.3 c A
0
1
2
3
FIG.3 d G
FIG.3 e R
FIG.3 f P
FIG.3 g L
FIG.3 h AA
0
1
2
3
4
5
6
FIG.3 i B1
(BB1)
FIG.3 j B2
(BB2)
FIG.3 k B3
(BB3)
FIG.3 l B4
(BB4)
FIG.3 m B5
(BB5)
FIG.3 n S1
FIG.3 o S2
FIG.3 p S3
FIG.3 q S4
FIG.3 r S5

PRIOR ART

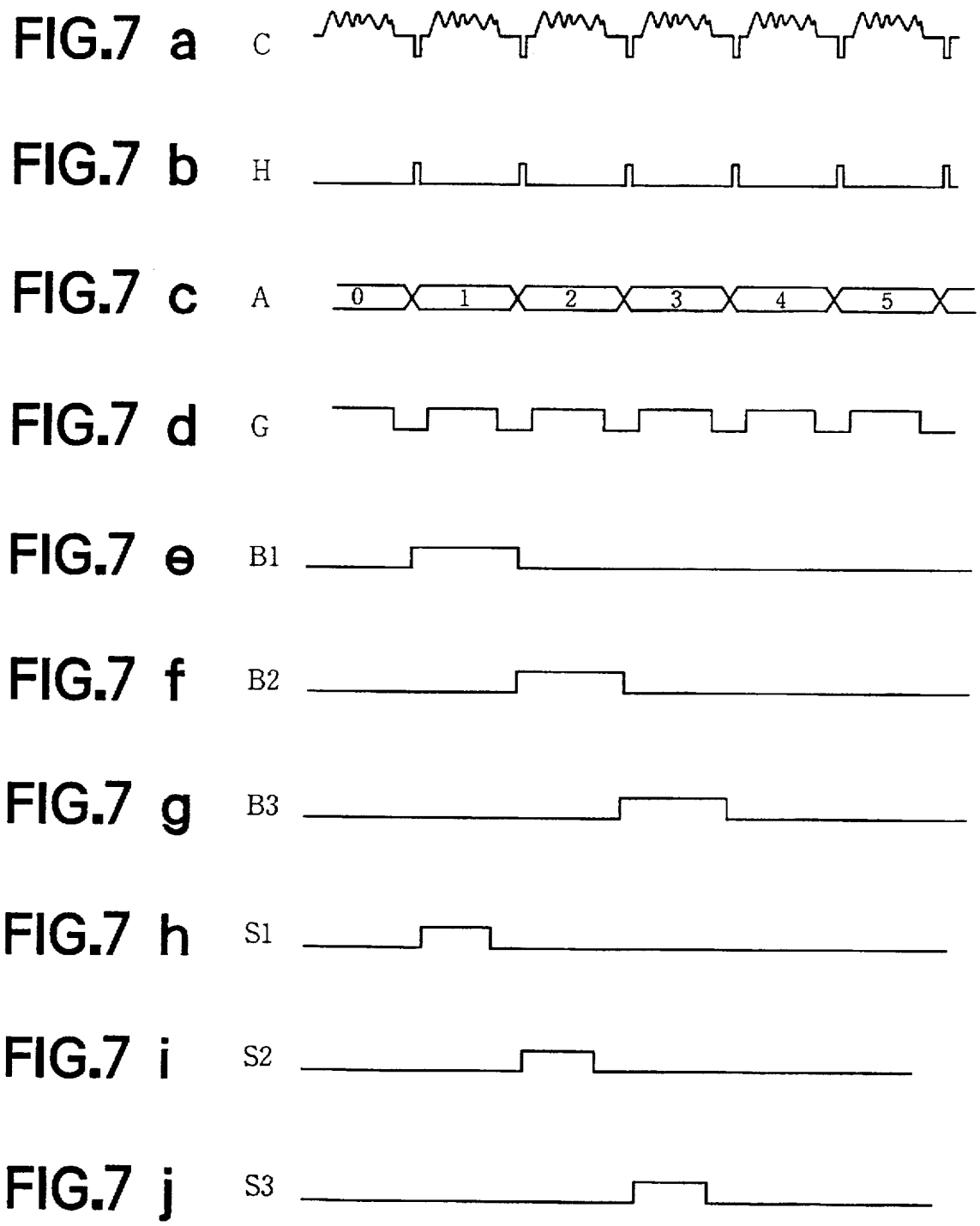
PRIOR ART

DRIVE SYSTEM FOR A FLAT TYPE DISPLAY DEVICE

BACKGROUND OF THE INVENTION

The present invention relates to a system for driving a flat type display device, and more particularly to a drive system available for various video signals which are different in the number of the scanning lines per picture, namely for multiple scanning.

Conventionally, in order to drive a flat-type display device of a matrix for displaying an image on a flat display panel, thereby providing a line-at-a-time scanning system.

FIG. 6 shows a conventional drive system for driving a liquid crystal display panel 10 of an active matrix. In the drive system, a control circuit 30, a column electrode drive circuit 20, and a row electrode drive circuit 40 are provided for line sequential scanning of the liquid crystal display panel 10.

The liquid crystal display panel 10 includes a plurality of pixels disposed in matrix of m rows x n columns. Corresponding to the pixels, gate lines Sl to Sm on m rows and data lines Dl to Dn on n columns are provided. Between the gate line and the data line, a MOS transistor 10*a* is connected as a switching element in each pixel.

The control circuit 30 includes a synchronous separation circuit 31 to which a video signal C is applied for separating a horizontal synchronizing signal H and a vertical synchronizing signal V of the video signal C.

The horizontal and vertical synchronizing signals H and V are applied to a vertical address generator 32. The vertical address generator 32 is initialized by the vertical synchronizing signal V and operated to count the horizontal synchronizing signal H for generating a vertical address A.

The horizontal synchronizing signal H is further applied to a dot clock generator 33 for generating a dot clock DCLK in synchronism with the horizontal synchronizing signal H in phase.

The dot clock DCLK is inputted into a horizontal address generator 34 which also receives the horizontal synchronizing signal H. The horizontal address generator 34 is initialized by the horizontal synchronizing signal H and operated to count the dot clock DCLK for generating a horizontal address A.

The horizontal address A is applied to a gate pulse generator 35 in which a gate pulse G is generated based on the horizontal address A.

The vertical address A and the gate pulse G are applied to the row electrode drive circuit 40 for producing scanning pulses. The dot clock DCLK is further applied to the column electrode drive circuit 20 for standardizing shift timing.

The column electrode drive circuit 20 comprises shifters of n-stage for converting display data in a series into parallelly arranged display data and has a holding circuit 21 for holding the video data so as to apply display data of one scanning line to the display panel 10 in parallel.

Although it is not shown, the column electrode drive circuit 20 also includes a holding circuit other than the holding circuit 21 to alternately or sequentially input and output the display data with the holding circuit 21. A data driver provides for amplifying the data held in the holding circuit 1 for applying the data to the data lines Dl to Dn.

The row electrode drive circuit 40 is provided for applying the scanning pulses to the gate lines Sl to Sm by the line sequential scanning based on the video signal. The row electrode drive circuit 40 includes a decoder 41 having a plurality of decode lines Bl to Bm, and a gate circuit 42 comprising a plurality of gates 42*a* provided corresponding to the decode lines Bl to Bm. Each of the decode lines Bl to Bm is connected to one of the input terminals of the corresponding gates 42*a* of the gate circuit 42. The other input terminal of each gate 42*a* is applied with the gate pulse G from the gate pulse generator 35 of the control circuit 30. An output terminal of the gate 42*a* is connected to each of the respective gate lines Sl to Sm.

The decoder 41 is supplied with the vertical address A from the vertical address generator 32 of the control circuit 30 for activating the decode lines Bl to Bm in order in accordance with the value of the vertical address A. A decoded signal is applied to the corresponding gate 42*a* in which a logical product is obtained in accordance with the gate pulse G. The gate 42*a* produces a scanning pulse which is applied to the display panel 10 through the corresponding gate line of Sl to Sm.

Although it is not shown, level shifters and gate drivers for amplifying the power are disposed between the gate circuit 42 and the gate lines Sl to Sm The operation of the system now will now be described. FIG. 7 shows waveforms of the respective signals. The digital signals are unified by positive logic.

When the video signal C shown in FIG. 7*a*, is applied to the drive system, the control circuit 30 operates to separate the vertical synchronizing signal V and the horizontal synchronizing signal H, as shown in FIG. 7*b*, from the video signal C. Based on the vertical and horizontal synchronizing signals V and H, the vertical address A, gate pulse G and dot clock DCLK are generated.

The vertical address A is initialized to "0" by the vertical synchronizing signal V, and proceeds sequentially "1", "2", . . . "m " as shown in FIG. 7*c*, in synchronism with the horizontal synchronizing signal H.

The gate pulse G produced, based on the horizontal address A', has a pulse width corresponding to a predetermined range of the horizontal address A'. The predetermined range is a period in which data held in the holding circuit 21 is stable and determined in accordance with a period in which the scanning pulse is ready to feed. As shown in FIG. 7*d*, the gate pulse G represents a first interval wherein the sending of the scanning pulse is suppressed from being applied for line sequential scanning between the pulses, and a second interval where the sending of the scanning pulse is allowed to be applied by the pulse. Generally, the first interval coincides with the retrace line interval, and the second interval coincides with the horizontal scanning period. Thus, the gate pulse G is produced corresponding to the horizontal scanning period.

In the column electrode drive circuit 20, the video signal C is applied in series in synchronism with the dot clock DCLK and the display data for one horizontal scanning period is held in the holding circuit 21. The held display data is applied to the data lines Dl to Dn, which are in parallel, at a new period delayed one horizontal scanning period. At the time, a display data of a next one scanning is applied to the net holding circuit in series and held therein. At a period after the next period, the display data held in the other holding circuit is applied to the data lines Dl to Dn in parallel. Thus, the display data of the video signal C is applied to the data lines Dl to Dn by a delay of one horizontal scanning period.

In the row electrode drive circuit 40, the vertical address A is decoded by the decoder 41 to activate the decode lines B1, B2, B3, . . . in order in synchronism with the horizontal synchronizing signal H as shown in FIGS. 7*e*, 7*f* and 7*g*. The decoded signals of the decode lines pass the gate 42*a* in sequential order in accordance with the gate pulse G. Thus, the vertical scanning pulse having a pulse width corresponding to the pulse width of the gate pulse G is applied to the gate lines S1, S2, S3, . . . in sequential order, as shown in FIGS. 7*h*, 7*i* and 7*j*.

In the liquid crystal display panel 10, the MOS transistor 10*a* is connected to the gate line of Sl to Sm is turned on. Signal voltage of data lines of Dl to Dn is applied to the corresponding n electrodes. Thus, a content for displaying the picture for one field corresponding to the gate line is changed.

As the gate line applied with the scanning pulse is transferred in order, the content for displaying the picture is changed in order per unit of the row.

Recently, a high definition display having a high definition driving system has been developed. It is requested that the high definition driving system for the high definition display can be used for the standard definition display. Therefore, a driving system is developed so that the vertical scanning frequency of the video signal can be selectively changed by a computer system. In such a system, the number of vertical scanning lines in a field dependent on the video signal is changeable any time.

If a video signal for the high definition display is applied to the drive system for the high definition display device, the number of vertical scanning lines in one field of the video signal coincides with the number of entire rows of the display device (number of row electrodes). Thus, the image can be normally displayed on the display. However, if the number of vertical scanning in the field is smaller than the number of entire rows of the display device, the image is displayed on a part of the display in the vertical direction. For example, if the video signal having 480 scanning lines in the field is applied to the display device having 1000 rows and driven by the conventional drive system, the image is displayed on an upper half of the display.

Consequently, it is desirable to develop the drive system for realizing a multiple scanning which is available for video signals having a different number of scanning lines per frame. However, in view of common use of parts of circuits and miniaturization of circuits, the conventional system can be changed without largely changing the structure.

SUMMARY OF THE INVENTION

An object of the present invention is to provide a drive system for a multiple scanning of a flat type display device.

1. According to the present invention, there is provided a drive system for a display including a plurality of column electrodes and a plurality of row electrodes, further including determining means for determining a number of vertical scanning lines in one field of a video signal and for determining number of scanning pulses at each row electrode based on the determined number of vertical scanning lines number and the number of the row electrodes determined by the determining means, storing means for storing the determined number of scanning pulses in a first interval where sending of the scanning pulses is suppressed, applying means for applying the scanning pulses to the corresponding row electrode in a second interval where scanning is allowed and the number of row electrodes to which the scanning pulses are applied is the stored number of scanning pulses.

The first interval is the retrace line interval, and the second interval is the horizontal scanning interval.

The determining means determines the number of scanning pulses by the difference between the number of vertical scanning in one field of the video signal and the number of the row electrodes.

These and other objects and features of the present invention will become more apparent from the following detailed description with reference to the accompanying drawings.

BRIEF DESCRIPTION OF DRAWINGS

FIGS. 3*a* to 3*r* show waveforms of signals in the drive system in a standard definition mode;

FIGS. 7*a* to 7*j* show waveforms of signals in the conventional drive system.

DETAILED DESCRIPTION OF THE PREFERRED EMBODIMENTS

Figure 1:
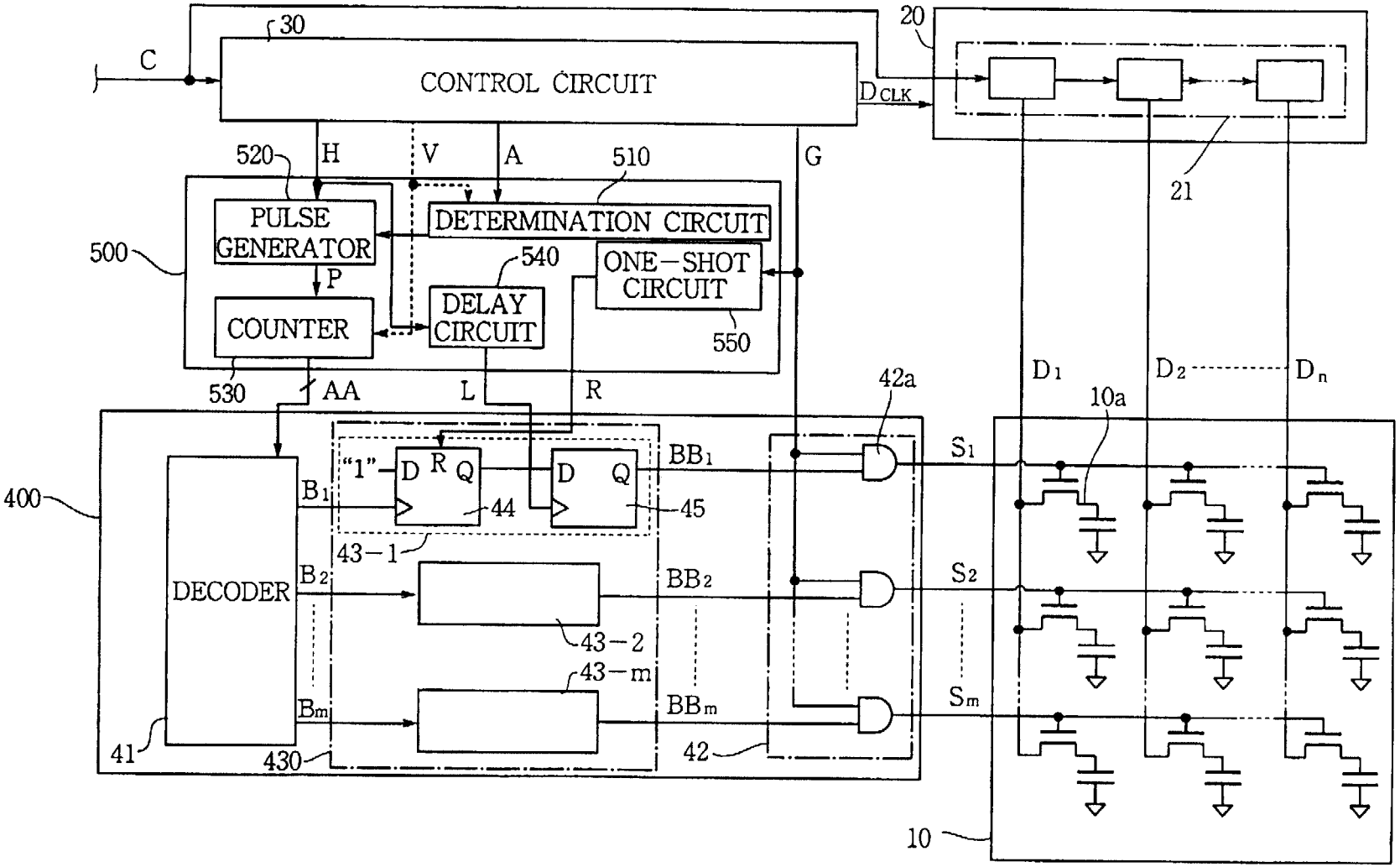
FIG. 1 is a block diagram showing a drive system for a flat type display device according to the present invention.

FIG. 1 shows a drive system of the present invention employed with common circuits of the conventional system so as to change the structure of the circuit of the conventional system as little as possible. Elements which are the same as those of the conventional system are identified with the same reference numerals, as shown on FIG. 6, and descriptions thereof are omitted.

Figure 6:
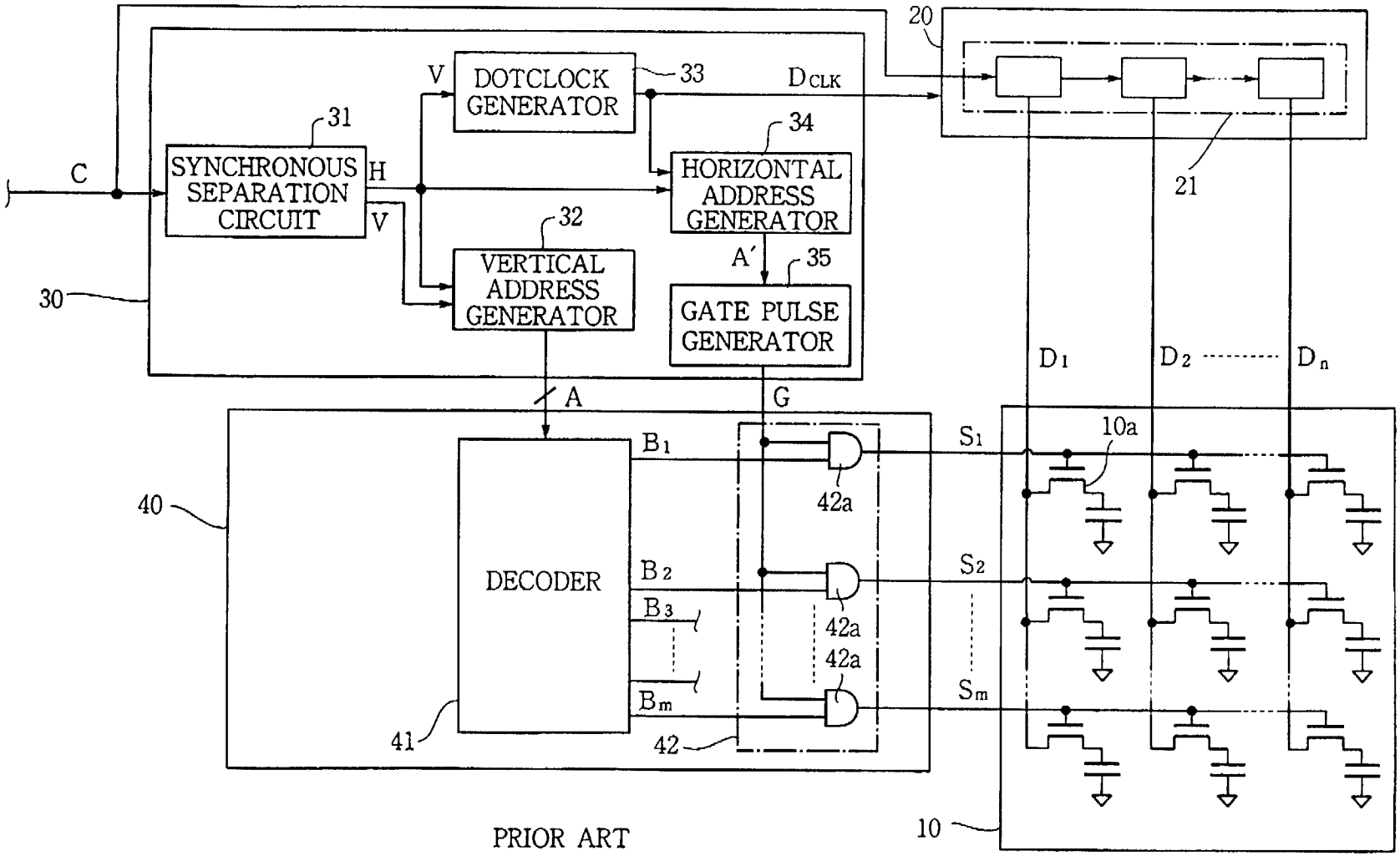
FIG. 6 is a block diagram showing a conventional drive system.

The drive system of the present invention includes a row electrode drive circuit 400 in place of the row electrode drive circuit 40 of FIG. 6, and a scanning changeover circuit 500 disposed between the control circuit 30 and the row electrode drive circuit 400. The row electrode drive circuit 400 includes a storage circuit 430 disposed between the decoder 41 and the gate circuit 42.

The scanning changeover circuit 500 and the row electrode drive circuit 400 perform the scanning by the number of allotted lines in the first interval.

The scanning changeover circuit 500 is employed to produce signals such as a scan address AA, a latch timing signal L, and a reset signal R for correcting the scanning in accordance with signals such as horizontal and vertical synchronizing signals H and V, and vertical address A for the scanning. The signals are applied to the row electrode drive circuit 400.

The scanning changeover circuit 500 includes a determination circuit 510 as a changeover means, a pulse generator 520, a counter 530 as a scanning changing means, a delay circuit 540 and a one-shot circuit 550 for controlling an operational timing of the storage circuit 430 of the row electrode drive circuit 400.

The determination circuit 510 is supplied with the vertical synchronizing signal V and the vertical address A. The determination circuit includes a latch circuit for latching a maximum value of the vertical address A in synchronism with the vertical synchronizing signal V, and a comparing circuit for comparing the maximum value with a predetermined threshold value to generate a compared result as a determined signal.

The maximum value of the vertical address A approximately coincides with the number of horizontal scanning lines included in a frame.

For example, in a computer system having a changeover function for the scanning line numbers of 480 and 1000, the threshold value of the comparing circuit is 740=(480+1000)/2. Therefore, the determination circuit 510 determines that the number of scanning lines of the video signal is 1000 when the maximum value of the vertical address A is larger than 740. When the maximum value of the vertical address A is smaller than 740, the determination circuit 510 determines that the number of the scanning lines is 480.

When the number of scanning lines of the video signal C is 1000, one row of the display panel 10 is allotted to each scanning line of the video signal C. When the number of scanning lines of the video signal C is 480, two rows of the display panel 10 are allotted to each scanning line of the video signal C.

Namely, the determination circuit 510 determines the number of horizontal scanning lines included in the frame in accordance with the maximum value, and operates to change the number of scanning lines of the display panel 10 allotted to each scanning line of the video signal C based on the number of the scanning lines of the display.

The pulse generator 520 is applied with the horizontal synchronizing signal H for generating a scanning pulse signal P in accordance with the determined result from the determination circuit 510. The number of pulses generated at one time is changed based on the determined result. When the determined result is 1000 scanning lines, the pulse generator 520 generates the scanning pulse signal P of one pulse per one row. When it is determined that there are 480 scanning lines, the pulse generator 520 generates the pulse signal P of two pulses per row. The pulse signal P is generated within a range of the retrace line interval as the first interval (FIG. 2). The pulse signal P is applied to the counter 530.

The counter 530, including a counter, is initialized by the vertical synchronizing signal V. The counter 530 counts the pulse signal P for generating a scan address AA. A counted value is increased with the applied pulse signal P. When it is determined that there are 1000 scanning lines, the scan address AA is advanced by one at one horizontal scanning. On the other hand, when it is determined that there are 480 scanning lines to be scanned, the scan address AA is advanced by two. The scan address AA is applied to the decoder 41 of the row electrode drive circuit 400 for correcting the line sequential scanning.

Thus, the scanning changeover circuit 500 and the row electrode drive circuit 400 advance the scanning by the allocated number in the first interval (retrace line interval).

To the delay circuit 540 is applied the horizontal synchronizing signal H, so that the latch timing signal L is generated for delaying the signal a predetermined time. The delay time of the signal L is set between a trailing edge of the pulse signal P and a leading edge of the gate pulse G (FIG. 2).

To the one-shot circuit 550, including a one-shot, is applied to the gate pulse G for generating a reset pulse R at a time before a leading edge of the pulse signal P (FIG. 2).

The reset signal R and the latch timing signal L are applied to the storage circuit 430 to reset stored content and complete a storing operation in the first interval.

The storage circuit 430 includes a plurality of line scanning storage circuits 43-1, 43-2, . . . 43-m connected to the respective decode lines B1, B2, . . . Bm of the decoder 41.

The line scanning storage circuits 43-1 includes a preceding D-type flip-flop 44 and a following D-type flip-flop 45. The preceding D-type flip-flop 44 has a data input D applied with a value of "1", a clock input connected to the decode line B1, a reset input R to which is applied the reset signal R of the one-shot circuit 550, and an output Q. The following D-type flip-flop 45 has a data input D connected to the output Q of the preceding D-type flip-flop 44, a clock input applied with the latch timing signal L of the delay circuit 540, and an output Q connected to a scan line BBl which is connected to the gate 42*a* of the gate circuit 42.

Other line scanning storage circuits 43-2, . . . 43-m are of the same construction and operation as the storage circuit 43-1. The outputs Q of the following flip-flop 45 are connected to the respective gates 42*a* through the corresponding scan lines BB2 to BBm.

When the reset signal R is applied to the storage circuit 430, all of the preceding flip-flops 44 are reset. When the scan address AA applied to the decoder 41 changes, a decode signal of one of the decode lines Bl to Bm becomes positive. The preceding flip-flop 44 of the corresponding line scanning storage circuit is operated to latch to the value of "1" at the leading edge. Since the scan address AA is advanced sequentially one by one when 1000 lines are being scanned, and is advanced two by two when 480 lines are being scanned, the flip-flop corresponding to one line or two lines is operated to latch to the value of "1". Thus, the storage circuit 430 stores the scanned line in the first interval.

When the latch timing signal L is applied to the storage circuit 430, the line information stored in the preceding flip-flop 44 is latched to the following flip-flop 45 and further applied to the gate 42*a* through the corresponding scan line of BB1 to BBm.

The corresponding gate 42*a* generates a scanning pulse through the corresponding gate line of Sl to Sm in the second interval of the gate pulse G.

The operation will now be described with reference to FIGS. 2 and 3. FIG. 2 shows waveforms of signals in a high definition mode having 1000 scanning lines in one field of the video signal C. FIG. 3 shows waveforms of signals in a standard mode having 480 scanning lines. Similar to the conventional system, the digital signals are unified by positive logic.

The operation in the high definition mode will now be described first.

Figures 2A, 2B, 2C, 2D, 2E, 2F, 2G, 2H, 2I, 2J, 2K, 2L, 2M, 2N, 2O, 2P, 2Q, 2R:
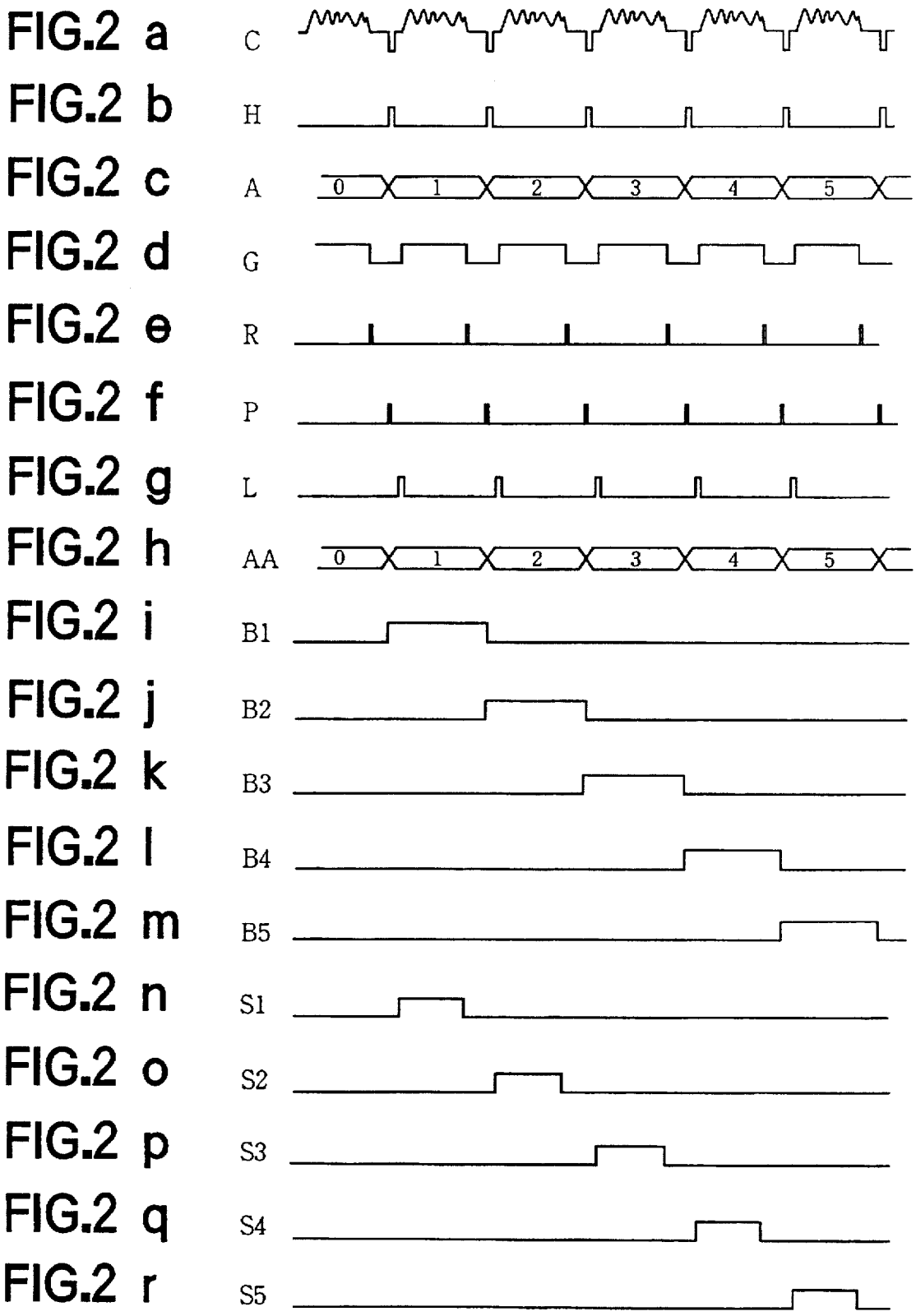
FIGS. 2*a* to 2*r* show waveforms of signals in the drive system in a high definition mode.

In the control circuit 30, the horizontal synchronizing signal H, vertical address A, and gate pulse G, as shown in FIGS. 2*b*, 2*c*, and 2*d*, are produced in accordance with the video signal C, as shown in FIG. 2*a*, in the same manner as the conventional system. In the column electrode drive circuit 20, similar to the conventional system, the display data of one scanning of the video signal C is held in the holding circuit 21 and applied to the data lines Dl to Dn in parallel.

The determination circuit 510 of the scanning changeover circuit 500 determines the high definition mode. The reset signal R, pulse signal P, and latch timing signal L are produced in order at each pulse of the horizontal synchronizing signal H as shown in FIGS. 2*e*, 2*f*, and 2*g*.

The scan address AA is advanced at each pulse of the pulse signal P sequentially one by one such as "1", "2", . . . "m" as shown in FIG. 2*h*.

In the row electrode drive circuit 400, the scan address AA is decoded by the decoder 41 to activate the decode lines B1, B2, B3, B4, B5, . . . sequentially in synchronism with the pulse signal P as show in FIGS. 2*i* to 2*m*

The line scanning storage circuits 43-1, 43-2, . . . 43-m are then latched to activate the corresponding scan lines BB1, BB2, BB3, BB4, BB5, . . . BBm sequentially at every horizontal scanning.

Finally, the signal of the scanning signals and the gate pulse G are applied to the gate 42*a* to produce the logical product. Thus, the scanning pulse, having a pulse width corresponding to the pulse width of the gate pulse G, namely the horizontal scanning period, is applied to the gate lines S1, S2, S3, S4, S5 . . . subsequentially at ever scanning of the video signal C as shown in FIGS. 2*n* to 2*r*.

In the liquid crystal display panel 10, the MOS transistor 10*a* connected to the gate line of Sl to Sm, is turned on. Signal voltage of data lines of Dl to Dn is applied to the corresponding n electrodes. Thus, the content, for displaying the picture for one field corresponding to the gate line, is changed.

As a result, in the high definition mode, the vertical scanning is performed similar to the conventional scanning system.

Describing the operation in the standard mode, as shown in FIG. 3*a*, the number of the scanning lines of the video signal C is approximately half that of the high definition mode. Therefore, in the operation, the image of the same scanning line is displayed by two lines of the display panel 10 so that the image is displayed on the entire display surface.

The horizontal synchronizing signal H, vertical address A, and gate pulse G are produced, as shown in FIGS. 3*b*, 3*c*, and 3*d*, in accordance with the video signal C in the same manner as aforementioned. Similarly, the display data of one scanning of the video signal C is held in the holding circuit 21 and applied to the data lines Dl to Dn in parallel.

The determination circuit 510 of the scanning changeover circuit 500 determines the standard mode. Therefore, the pulse generator 520 produces two pulse signals P between the reset signal R and the latch timing signal L as shown in FIGS. 3*e*, 3*f*, and 3*g*.

The scan address AA advanced at each pulse signal P is advanced by two at "1" with a short interval, and advanced by two at "3" with a short interval, with a long interval "2" interposing, and thereafter similarly advanced, sequentially at every pulse of the horizontal synchronizing signal H as shown in FIG. 3*h*.

In the row electrode drive circuit 400, the scan address AA is decoded by the decoder 41, thereby activating the decode line B1, having a short interval, the decode line B2, having a long interval, the decode line B3 having a short interval, . . . sequentially in synchronism with the pulse signal P as show in FIGS. 3*i* to 3*m*.

The decoded signals are then latched in the line scanning storage circuits 43-1, 43-2, . . . 43-m to activate every two scan lines BB1 and BB2, BB3 and BB4, and BB5 . . . sequentially for generating data in synchronism with the latch timing signal L as shown by dotted lines of FIGS. 3*i* to 3*m*.

Finally, the signal of the scanning signals and the gate pulse G are applied to the gate 42*a* to produce the logical product. Thus, the scanning pulse, having a pulse width corresponding to the pulse width of the gate pulse G, namely the horizontal scanning period, is applied to every two gate lines S1 and S2, S3 and S4, and S5 . . . sequentially at every scanning of the video signal C as shown in FIGS. 3*n* to 3*r*.

In the liquid crystal display panel 10, the MOS transistors 10*a* connected to the two gate lines are turned on. Signal voltage of data lines of Dl to Dn is applied to corresponding electrodes. Thus, contents for displaying the picture, for two fields corresponding to the gate lines, are changed.

As a result, in the standard mode the vertical scanning is corrected to a scanning speed variable system. Thus, the image is vertically expanded, twice as much, to be displayed on the entire display surface.

The scanning system is based on the system described in the conventional system. Although, the first and second intervals, which coincide with the retrace line interval and the horizontal scanning period respectively as aforementioned, the intervals can be changed to other periods.

Figure 4:
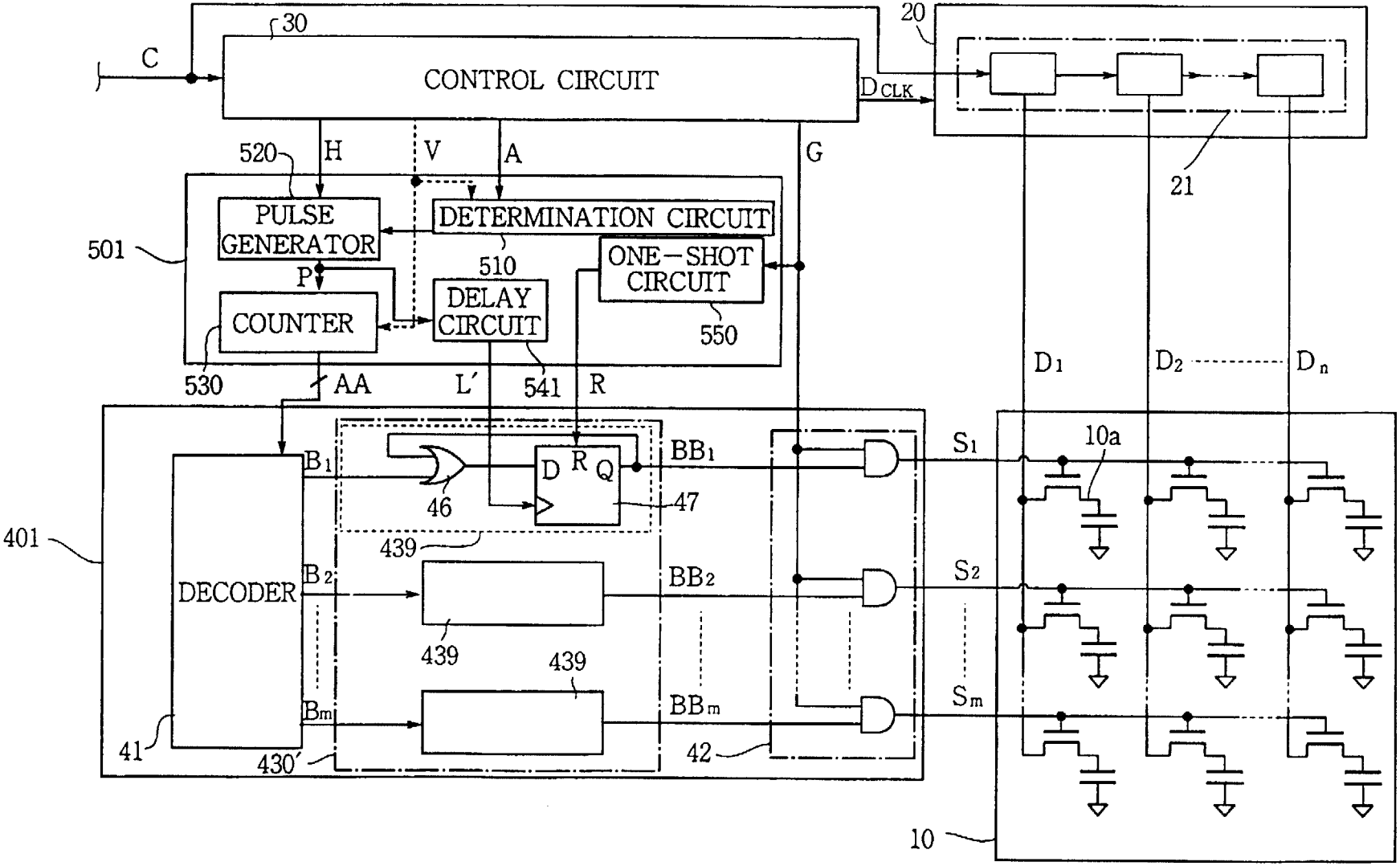
FIG. 4 is a block diagram showing a drive system for a second embodiment of the present invention.

Referring to FIG. 4, showing a second embodiment of the drive system, a scanning changeover circuit 501 includes a delay circuit 541 for producing a latch timing signal L'. To the delay circuit 541 is applied with the pulse signal P from the pulse generator 520 for delaying the signal by a predetermined time.

A row electrode drive circuit 401 includes a storage circuit 430' provided between the decoder 41 and the gate circuit 42. The storage circuit 430' includes a plurality of line scanning storage circuits 439 corresponding to the decode lines B1 to Bm. Each line scanning storage circuit 439 includes an OR gate 46 and a D-type flip-flop 47.

The D-type flip-flop 47 includes a data input D connected to the output of the gate 46, a clock input applied with the latch timing signal L', a reset input R applied with the reset signal R of the one-shot circuit 550, and an output Q connected to the scanning line of BB1 to BBm and to one of input terminals of the gate 46. The other input terminal of the gate 46 is connected to the decode line of B1 to Bm.

The delay time of the delay circuit 541 is set to a time longer than the time necessary for a stable output of the decoder 41 and shorter than the pulse interval of the pulse signal P.

Other structures are the same as those of the previous embodiment of FIG. 1, wherein the same elements thereof are identified with the same reference numerals as FIG. 1.

The operation is similar to the previous embodiment, wherein the line scanning storage circuits 439 are reset by the reset signal R. The scanning line corresponding to the decode line for scanning is then activated to apply the scanning pulse for multiple scanning to the display panel through the gate line.

The present embodiment is more durable against undesirable glitches due to the decoder 41.

Figure 5:
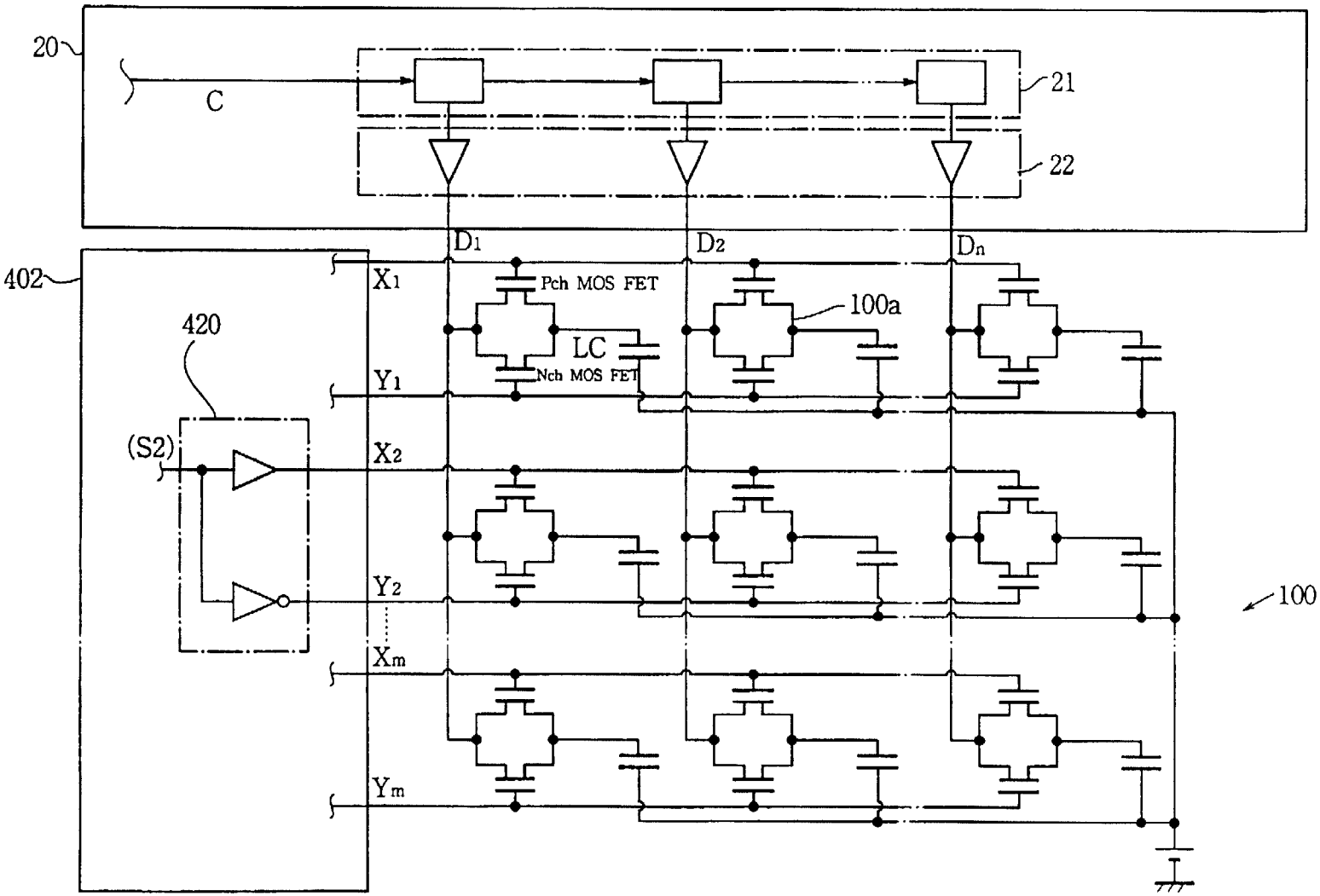
Fig. 5 is a block diagram showing a drive system for a third embodiment of the present invention.

FIG. 5 shows a third embodiment in which a display panel 100 includes a plurality of transfer gates 100*a* as switching elements. Each transfer gate 100*a* includes a p-channel MOS-FET and an n-channel MOS-FET which are connected to gate lines X1 and Y1, X2 and Y2, . . . Xm and Ym, respectively. A row electrode drive circuit 402 includes a gate driver 420 for driving the corresponding gate lines X1 and Y1, X2 and Y2, . . . Xm and Ym. The gate driver generates a pair of positive and negative scanning pulses for driving the gate lines.

From the foregoing, the drive system of the present invention is applicable to the liquid crystal display panel employed with transfer gates.

A drive system, which is more practical and simple in structure, will now be described. In the system, the gate circuit 42 is omitted so that the scanning line BB1 is directly connected to level shifter and gate driver for the gate line S1 irrespective of the gate pulse G. The variations and outputs of the signals, such as scan address AA, latch timing signal L, and reset signal R are limited in the retrace line interval. Furthermore, the output timing of the holding circuit 21 in the column electrode circuit 20 is also changed in the retrace line interval.

Thus, in the drive system, the scanning system operates to change the display data at every horizontal scanning in the horizontal retrace line interval of the video signal. The scanning changeover circuit operates to scan the signals in the horizontal retrace line interval in place of the first interval. The storage circuit stores the scanning line, and in the horizontal interval in place of the second interval, the storage circuit operates to drive the line of the display device corresponding to the stored content. Since the storage circuit 430 serves as the gate circuit 42, the gate circuit 42 is omitted.

The timings for changing the signal and changing the data are limited in the retrace line interval, and the retrace line interval is a very short period less than 10 percent of the period of horizontal scanning (1H). Thus, in an ordinary liquid crystal display panel, which can not follow such a short drive, the content of display does not actually deteriorate by the absence of gate circuit 42. Even if in the case of a display panel having a high response, if the output timing of the holding circuit 21 is set and adjusted after the reset signal R is generated, the gate circuit 42 can be omitted.

Consequently, the drive system is provided with a simpler circuit structure.

The drive system is also applicable to a plasma display or an EL display.

The number of pulses of the pulse signal P can be increased to three or four or more corresponding to the number of scanning lines in the frame, or one pulse and two pulses can be alternately generated. Thus, it is possible to provide a multi-stage change of three or four times, and an arbitrary multiple, such as one and a half times.

In accordance with the present invention, the number of scanning lines in one frame period can be changed in accordance with the number of scanning lines of the video signal. Consequently, the drive system for the multiple scanning, using the line-at-a-time scanning system, can be effectively realized.

Particularly, if the timings for changing of the signal and changing over of the data are limited in the retrace line interval, it is possible to provide the drive system with a simpler circuit structure.

While the invention has been described in conjunction with preferred specific embodiment thereof, it will be understood that this description is intended to illustrate and not limit the scope of the invention, which is defined by the following claims.

What is claimed is:

1. A drive system for a display having a plurality of column electrodes and a plurality of row electrodes, comprising:

determining means for determining a number of horizontal lines in one frame of a video signal and for determining a number of rows to be simultaneously scanned by scanning pulses at each horizontal scanning of the video signal in accordance with the determined number of the horizontal lines in the video signal and the total number of row electrodes of the display;

storing means for storing the determined number of rows to be simultaneously scanned at each horizontal scanning to generate the scanning pulses having the substantially same timing; and applying means for shaping and applying the scanning pulses to corresponding row electrodes in synchronization with the video signal to provide the simultaneously scanned rows with the same video signal corresponding to one of the horizontal lines of the video signal.

2. The system according to claim 1, wherein the time interval of the scanning pulses generated by the storing means includes a retrace line interval, and the scanning pulses shaped by the applying means has a time interval corresponding to a horizontal scanning interval not overlapping with the retrace line interval.

3. The system according to claim 1, wherein the determining means determines the number of rows to be simultaneously scanned by the scanning pulses at each horizontal scanning of the video signal by a difference between the number of vertical scanning lines in one frame of the video signal and the number of the row electrodes.

4. A display driver for displaying video signals having a vertical resolution less than a vertical resolution of a display panel in a substantially entire display area of the display panel, the display panel having an array of pixels with predetermined numbers of rows and columns, the display driver comprising:

a determination circuit that detects the number of horizontal lines contained in each frame of the video signals, the determination circuit grouping the rows of pixels into a plurality of groups, the total number of the groups being substantially equal to the detected number of horizontal lines; and a pulse generator that processes data representing the grouping of the rows of pixels to generate scanning pulses to be applied to each group of rows of pixels, wherein the scanning pulses to be applied to the same group of rows have a substantially same timing to receive and display the same horizontal line of the video signals.

5. The display driver according to claim 4, wherein the determination circuit successively groups the rows of pixels into the plurality of groups from the top row, and the number of rows contained in each group of rows is the same among all the groups.

6. The display driver according to claim 5, wherein the determination circuit determines the number of rows of pixels in each group to be 1 if the detected number is larger than a predetermined threshold value which is substantially equal to a half of the total number of rows of pixels in the display panel, and wherein the determination circuit determines the number of rows of pixels in each group to be 2, if the detected number is equal to or less than the predetermined threshold value.

7. The display driver according to claim 4, wherein the pulse generator includes:

a delay circuit for delaying clock pulses which are in synchronization with the video signals to generate delayed pulses having a substantially same timing for each of the groups of rows, and an application circuit for processing the delayed pulses to generate the scanning pulses to be applied to each group of rows, the scanning pulses to be applied to the same group of rows having a substantially same timing and being separated in time from a retrace line interval.

8. A method for displaying video signals having a vertical resolution less than a vertical resolution of a display panel in a substantially entire display area of the display panel, the display panel having an array of pixels with predetermined numbers of rows and columns, the method comprising the steps of:

detecting the number of horizontal lines contained in each frame of the video signals;

grouping the rows of pixels into a plurality of groups, the total number of the groups being substantially equal to the detected number of horizontal lines; and processing data representing the grouping of the rows of pixels to generate scanning pulses to be applied to each group of rows of pixels, wherein the scanning pulses to be applied to the same group of rows have a substantially same timing to receive and display the same horizontal line of the video signals.

9. The method according to claim 8, wherein the step of grouping includes successively grouping the rows of pixels into the plurality of groups from the top row, the number of rows grouped in each group of rows being the same among all the groups.

10. The method according to claim 9, wherein the step of grouping includes the steps of:

determining the number of rows of pixels in each group to be 1 if the detected number is larger than a predetermined threshold number which is substantially equal to a half of the total number of rows of pixels in the display panel; and determining the number of rows of pixels in each group to be 2, if the detected number is equal to or less than the predetermined threshold number.

* * * * *